US010937368B2

(12) United States Patent
Peng et al.

(10) Patent No.: US 10,937,368 B2
(45) Date of Patent: Mar. 2, 2021

(54) VOLTAGE COMPENSATION METHOD, VOLTAGE COMPENSATION DEVICE, DISPLAY DEVICE AND COMPUTER-READABLE STORAGE MEDIUM

(71) Applicant: BOE TECHNOLOGY GROUP CO., LTD., Beijing (CN)

(72) Inventors: Jintao Peng, Beijing (CN); Kuanjun Peng, Beijing (CN); Wei Qin, Beijing (CN); Chengchung Yang, Beijing (CN); Wanpeng Teng, Beijing (CN); Zhiqiang Xu, Beijing (CN); Xueling Gao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/613,273

(22) PCT Filed: Mar. 21, 2019

(86) PCT No.: PCT/CN2019/078970
§ 371 (c)(1),
(2) Date: Nov. 13, 2019

(87) PCT Pub. No.: WO2019/196615
PCT Pub. Date: Oct. 17, 2019

(65) Prior Publication Data

US 2020/0388222 A1 Dec. 10, 2020

(30) Foreign Application Priority Data

Apr. 13, 2018 (CN) ..... 201810329804.4

(51) Int. Cl.
*G09G 3/3258* (2016.01)

(52) U.S. Cl.
CPC ... *G09G 3/3258* (2013.01); *G09G 2300/0842* (2013.01); *G09G 2320/0257* (2013.01); *G09G 2320/0693* (2013.01)

(58) Field of Classification Search
CPC combination set(s) only.
See application file for complete search history.

(56) References Cited

U.S. PATENT DOCUMENTS

2006/0007209 A1 1/2006 Nakamura et al.
2006/0268366 A1* 11/2006 Chen ..... H04N 1/4095 358/474

(Continued)

FOREIGN PATENT DOCUMENTS

CN 105632449 A 6/2016
CN 105632450 A 6/2016

(Continued)

OTHER PUBLICATIONS

First Office Action for Chinese Application No. 201810329804.4, dated Sep. 4, 2019, 5 Pages.

(Continued)

*Primary Examiner* — Van N Chow
(74) *Attorney, Agent, or Firm* — Brooks Kushman P.C.

(57) ABSTRACT

A voltage compensation method, a voltage compensation device, a display device and a computer-readable storage medium are provided. The voltage compensation method includes: determining a first voltage of a target pixel in a first image; determining a second voltage of the target pixel in a second image, where the second image is switched from the first image; determining a voltage compensation value based on the first voltage and the second voltage; an determining a transition voltage based on the voltage compensation value and the second voltage, and compensating the second voltage by the transition voltage; where a gray-level of the target pixel in the first image is greater than a gray-level of the (Continued)

target pixel in the second image, the transition voltage is a driving voltage of the target pixel between the first voltage and the second voltage.

17 Claims, 5 Drawing Sheets

(56) References Cited

U.S. PATENT DOCUMENTS

| | | | | |
|---|---|---|---|---|
| 2009/0109156 | A1* | 4/2009 | Hu | G09G 3/3648 345/89 |
| 2013/0215096 | A1* | 8/2013 | Kim | G09G 3/3648 345/212 |
| 2013/0314389 | A1* | 11/2013 | Wang | G09G 3/3648 345/211 |
| 2016/0275869 | A1 | 9/2016 | Hwang et al. | |
| 2019/0096327 | A1 | 3/2019 | Peng et al. | |
| 2019/0206340 | A1* | 7/2019 | Guan | G09G 3/3607 |
| 2019/0355300 | A1 | 11/2019 | Wu et al. | |
| 2019/0385530 | A1* | 12/2019 | Gao | G09G 3/3258 |
| 2019/0385545 | A1* | 12/2019 | Guan | G06T 7/90 |
| 2020/0265788 | A1* | 8/2020 | Kim | G09G 3/3233 |

FOREIGN PATENT DOCUMENTS

| | | | |
|---|---|---|---|
| CN | 106205523 | A | 12/2016 |
| CN | 107103877 | A | 8/2017 |
| CN | 107452334 | A | 12/2017 |
| CN | 107492348 | A | 12/2017 |
| CN | 107610652 | A | 1/2018 |
| CN | 108538252 | A | 9/2018 |

OTHER PUBLICATIONS

International Search Report and Written Opinion for Application No. PCT/CN2019/078970, dated Jun. 6, 2019, 9 Pages.

* cited by examiner

VOLTAGE COMPENSATION METHOD, VOLTAGE COMPENSATION DEVICE, DISPLAY DEVICE AND COMPUTER-READABLE STORAGE MEDIUM

CROSS-REFERENCE TO RELATED APPLICATION APPLICATIONS

This application is the U.S. national phase of PCT Application No. PCT/CN2019/078970 filed on Mar. 21, 2019, which claims priority to Chinese Patent Application No. 201810329804.4 filed on Apr. 13, 2018, which are incorporated herein by reference in their entireties.

TECHNICAL FIELD

The present disclosure relates to the field of display technologies, and in particular, to a voltage compensation method, a voltage compensation device, a display device and a computer-readable storage medium.

BACKGROUND

The Active Matrix Organic Light Emitting Diode (AMOLED) is used more and more widely. The pixel display component of the AMOLED is an Organic Light-Emitting Diode (OLED). A driving Thin Film Transistor (TFT) at a saturated state generates a driving current, and the driving current drives the OLED to emit light, thereby driving the AMOLED to emit light.

SUMMARY

A voltage compensation method is provided in some embodiments of the present disclosure, including:

determining a first voltage of a target pixel in a first image;

determining a second voltage of the target pixel in a second image, where the second image is switched from the first image;

determining a voltage compensation value based on the first voltage and the second voltage; and determining a transition voltage based on the voltage compensation value and the second voltage, and compensating the second voltage by the transition voltage;

a gray-level of the target pixel in the first image is greater than a gray-level of the target pixel in the second image, the transition voltage is a driving voltage of the target pixel between the first voltage and the second voltage.

Optionally, the determining the voltage compensation value based on the first voltage and the second voltage includes:

performing a forward scan and a reverse scan respectively to a current-voltage curve for driving a thin film transistor TFT of the target pixel, based on the first voltage and the second voltage, and calculating a threshold voltage separation amount of the TFT based on a scan result;

determining the threshold voltage separation amount as the voltage compensation value.

Optionally, the determining the transition voltage based on the voltage compensation value and the second voltage and compensating the second voltage by the transition voltage includes:

determining a sum of the voltage compensation value and the second voltage as the transition voltage; and compensating the second voltage by the transition voltage.

Optionally, the compensating the second voltage by the transition voltage includes:

inserting an inbetween image between the first image and the second image, where a voltage adjustment value of the driving voltage of the target pixel between every two adjacent frames is: $1/N \times \Delta V_{gs}$, where N is a positive integer and represents a total number of frames of the inbetween image, and $\Delta V_{gs}$ represents a difference between the second voltage and the transition voltage.

Optionally, the compensating the second voltage by the transition voltage includes:

switching the driving voltage of the target pixel to the transition voltage, to compensate the second voltage.

Optionally, the compensating the second voltage by the transition voltage includes:

switching the driving voltage of the target pixel to the second voltage, after the driving voltage of the target pixel is kept at the transition voltage continuously for a preset duration.

A voltage compensation device is provided in some embodiments of the present disclosure, including:

a first determining module, configured to determine a first voltage of a target pixel in a first image;

a second determining module, configured to determine a second voltage of the target pixel in a second image, where the second image is switched from the first image;

a third determining module, configured to determine a voltage compensation value based on the first voltage and the second voltage; and a voltage compensating module, configured to determine a transition voltage based on the voltage compensation value and the second voltage, and compensate the second voltage by the transition voltage;

a gray-level of the target pixel in the first image is greater than a gray-level of the target pixel in the second image, the transition voltage is a driving voltage of the target pixel between the first voltage and the second voltage.

Optionally, the third determining module includes:

a first determining sub-module, configured to perform a forward scan and a reverse scan respectively to a current-voltage curve for driving a thin film transistor TFT of the target pixel, based on the first voltage and the second voltage, and calculate a threshold voltage separation amount of the TFT based on a scan result;

a second determining sub-module, configured to determine the threshold voltage separation amount as the voltage compensation value.

Optionally, the voltage compensating module includes:

a determining sub-module, configured to determine a sum of the voltage compensation value and the second voltage as the transition voltage; and a voltage compensating sub-module, configured to compensate the second voltage by the transition voltage.

Optionally, the voltage compensating sub-module is configured to insert an inbetween image between the first image and the second image, where a voltage adjustment value of the driving voltage of the target pixel between every two adjacent frames is: $1/N \times \Delta V_{gs}$, where N is a positive integer and represents a total number of frames of the inbetween image, and $\Delta V_{gs}$ represents a difference between the second voltage and the transition voltage.

Optionally, the voltage compensating sub-module is configured to switch the driving voltage of the target pixel to the transition voltage, to compensate the second voltage.

Optionally, the voltage compensating sub-module is further configured to switch the driving voltage of the target pixel to the second voltage after the driving voltage of the target pixel is kept at the transition voltage continuously for a preset duration.

A display device is provided in some embodiments of the present disclosure, including the voltage compensation device hereinabove.

A display device is provided in some embodiments of the present disclosure, including: a memory, a processor and a computer program stored in the memory and executable by the processor, where the computer program is executed by the processor to perform the method hereinabove.

A computer-readable storage medium configured to store a computer program is provided in some embodiments of the present disclosure, where the computer program is executed by a processor to perform the method hereinabove.

DETAILED DESCRIPTION

The present disclosure will be described hereinafter in conjunction with the drawings and embodiments. Obviously, the following embodiments are merely to describe the present disclosure, but not to limit the present disclosure.

The residual image of the AMOLED display refers to the phenomenon that the image of the previous frame is residual when the display is switched from the image of the previous frame to the current image. For the AMOLED display, the existing duration of the residual image is directly related to the performance of the TFT.

The DTFT is a TFT component capable of driving the OLED of the AMOLED. Since the scanning direction of the gate voltage Vgate of the TFT component (i.e., a changing direction of the Vgate, e.g., the Vgate increases or decreases) changes, the threshold voltage Vth of the TFT component will drift ($\Delta V_{th}$). As a result, the hysteresis appears.

Due to the hysteresis of the DTFT, a driving current of switching a first pixel of a high gray-level image to a middle gray-level image is different from a driving current of switching a second pixel of a low gray-level image to the same middle gray-level image. That is, when inputting the same gage voltage to two DTFTs, the drain currents of the two DTFTs (i.e., the on-state currents) are different. Since the on-state currents of the DTFT determines a display brightness of the AMOLED display, a display brightness in the case of switching the pixel of the high gray-level image to the middle gray-level image is different from a display brightness in the case of switching the pixel of the low gray-level image to the same middle gray-level image, the residual image appears on the AMOLED.

Figure 1:
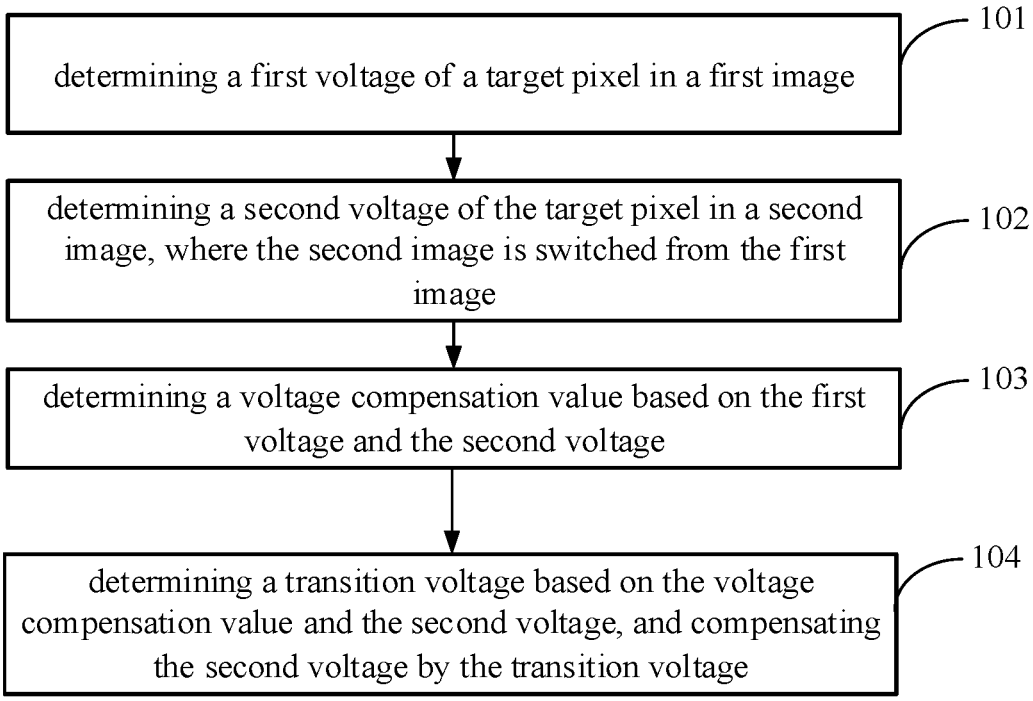
FIG. 1 is a flow chart of a voltage compensation method in some embodiments of the present disclosure.

As shown in FIG. 1, a voltage compensation method is provided in some embodiments of the present disclosure, including:

Step 101: determining a first voltage of a target pixel in a first image; Step 102: determining a second voltage of the target pixel in a second image, where the second image is switched from the first image.

A gray-level of the target pixel in the first image is greater than a gray-level of the target pixel in the second image. The target pixel may be any pixel. One pixel is a light-emitting unit with a single color (e.g., R pixel, G pixel and B pixel), and the pixels with various colors form a pixel unit. For example, the R pixel, G pixel and B pixel form a pixel unit. After the debugging of the product module is completed, the voltages corresponding to different gray-levels are determined. Therefore, the first voltage of the target pixel in the first image and the second voltage of the target pixel in the second image may be determined according to the method in the prior art.

Step 103: determining a voltage compensation value based on the first voltage and the second voltage.

In some embodiments of the present disclosure, the Step 103 includes: performing a forward scan and a reverse scan respectively to a current-voltage curve (I-V curve) for driving a thin film transistor TFT of the target pixel (i.e., DTFT), based on the first voltage and the second voltage, and calculating a threshold voltage separation amount of the TFT based on a scan result; determining the threshold voltage separation amount as the voltage compensation value. Step 104 includes: determining a transition voltage based on the voltage compensation value and the second voltage, and compensating the second voltage by the transition voltage.

The transition voltage is a driving voltage of the target pixel between the first voltage and the second voltage. That is, the value of the transition voltage is between the first voltage and the second voltage.

The first voltage and the second voltage are the driving voltages of the target pixel, i.e., the data voltage signaling written by a driving chip.

In some embodiments of the present disclosure, the Step 104 includes: determining a sum of the voltage compensation value and the second voltage as the transition voltage; and compensating the second voltage by the transition voltage.

In some embodiments of the present disclosure, in the dynamic image display, the compensating the second voltage by the transition voltage includes: using the transition voltage directly to compensate the second voltage. That is, the driving voltage of the target pixel is switched to the transition voltage, so as to compensate the second voltage.

The gray-level maintaining duration of the pixel in dynamic display image is shorter that in the static display image. The longer the gray-level maintaining duration of the pixel is, the smaller the hysteresis may be, and the smaller the threshold voltage separation amount may be.

In some embodiments of the present disclosure, in the static display image, the compensating the second voltage by the transition voltage includes: inserting an inbetween image between the first image and the second image, where a voltage adjustment value of the driving voltage of the target pixel between every two adjacent frames is: $1/N\times\Delta V_{gs}$, where N is a positive integer and represents a total number of frames of the inbetween image, and $\Delta V_{gs}$ represents a difference between the second voltage and the transition voltage.

For the static display image, since the display contents of consecutive frames may be the same, an inbetween image is inserted to compensate the second voltage, thereby avoiding the residual image.

For example, when switching the high gray-level image (the driving voltage of the pixel $P_H$ is −6V) to the middle gray-level image (the driving voltage of the pixel $P_H$ is −3V) and when switching the low gray-level image (the driving voltage of the pixel $P_L$ is 0V) to the middle gray-level image (the driving voltage of the pixel $P_L$ is −3V), the threshold voltage separation amount of the DTFT is −0.2V, and then the residual image appears on the display image.

According to the above method, when displaying the dynamic display image, the threshold voltage separation amount −0.2V is taken as the voltage compensation value when switching the high gray-level image to the middle gray-level image, and the sum of the voltage compensation value and the driving voltage of the pixel in the middle gray-level image (the sum is −3V+(−0.2V)=−3.2V) is determined to be the transition voltage, and then the driving voltage of the pixel $P_H$ is switched to the driving voltage −3.2V.

In some embodiments of the present disclosure, when displaying the static display image, the high gray-level image is switched to the middle gray-level image, and N frames of inbetween images (i.e., the $i_{th}$ inbetween image, i=1, . . . N) are inserted between the high gray-level image and the middle gray-level image, and a voltage adjustment value of the driving voltage of the target pixel between every two adjacent frames is: $1/N\times\Delta V_{gs}$, and the driving voltage of the pixel $P_H$ in the $i_{th}$ inbetween image=(the driving voltage of the pixel in the high gray-level image—the driving voltage of the pixel in the middle gray-level image)+$1/N\times\Delta V_{gs}\times(N+1-i)$.

For example, when displaying the static display image, the high gray-level image is switched to the middle gray-level image, four frames of inbetween images are inserted (i.e., a first inbetween image, a second inbetween image, a third inbetween image and a fourth inbetween image) between the high gray-level image and the middle gray-level image, that is, N=4, and a voltage adjustment value of the driving voltage of the target pixel between every two adjacent frames is: $1/N\times\Delta V_{gs}=\frac{1}{4}\times(-0.2)=-0.05V$. The driving voltage of the pixel $P_H$ in the first inbetween image=−3+(−0.05)×4=−3.20V. The driving voltage of the pixel $P_H$ in the second inbetween image=−3V+(−0.05)×3=−3.15V. The driving voltage of the pixel $P_H$ in the third inbetween image=−3V+(−0.05)×2=−3.10V. The driving voltage of the pixel $P_H$ in the fourth inbetween image=−3V+(−0.05)×1=−3.05V. The driving voltage of the pixel $P_H$ in the fifth frame image (i.e., the middle gray-level image) is the driving voltage −3V of the pixel in the middle gray-level image. In the process of the high gray-level image switching to the middle gray-level image, the driving voltage of the pixel $P_L$ is always the driving voltage −3V of the middle gray-level image.

In some embodiments of the present disclosure, the inserted inbetween picture includes a plurality frames of pictures or one frame of picture.

In the embodiment of the present disclosure, when performing screen switching, a voltage compensation value is determined based on the first voltage of the target pixel before the image switching and the second voltage of the target pixel after the image switching, and a transition voltage is determined based on the voltage compensation value and the second voltage, and then the second voltage is compensated by the transition voltage. Since the gray-level of the target pixel in the image before the switching (i.e., the first image) is greater than the gray-level of the target pixel in the image after the switching (i.e., the second image), that is, a high gray-level image is switched to a low gray-level image, the second voltage is compensated, thereby reducing or avoiding the short-term residual image of the OLED due to the hysteresis.

Figure 2:
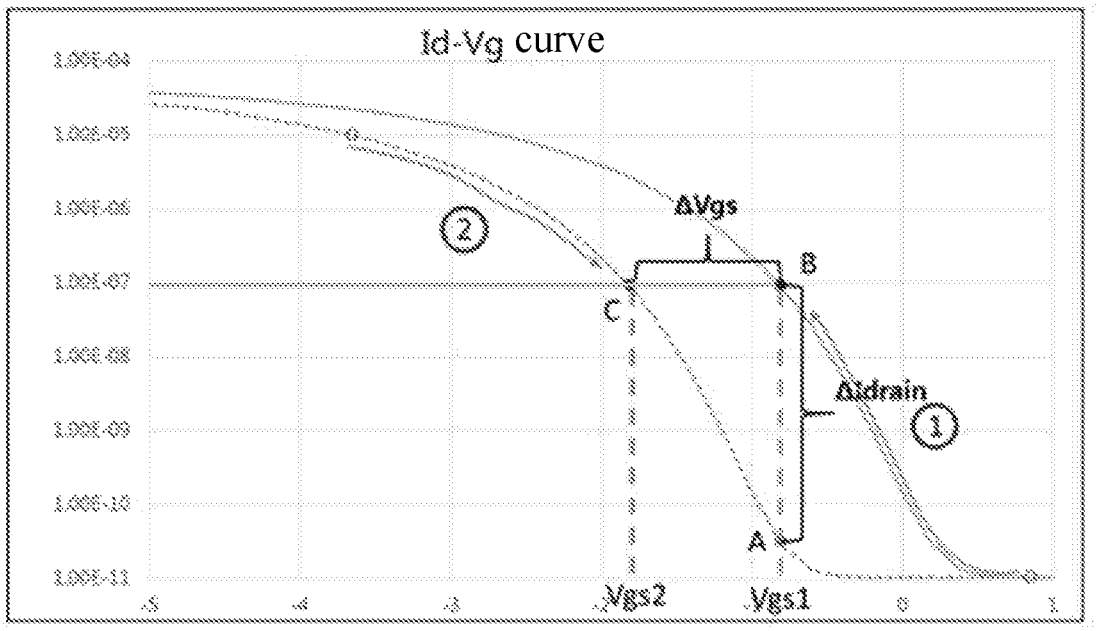
FIG. 2 is a schematic view of an actual current-voltage curve of an OLED in some embodiments of the present disclosure.

As shown in FIG. 2, the OLEDs in the AMOLED are current-driven devices that are sensitive to the current. When black and white images with different gray-levels are switched to the gray gray-level image (the driving voltage of the pixel in the gray gray-level image is $V_{gs}$1), due to the hysteresis appearing in the DTFT driving the pixel, the driving current of switching the pixel $P_b$ in the black gray-level image to the gray gray-level image (the voltage corresponding to the gray gray-level image is $V_{gs}$1) is $I_A$ (e.g., a drain current of the DTFT connected to the OLED shown in FIG. 5). The driving current of switching the pixel $P_W$ in the white gray-level image to the gray gray-level image is $I_B$, there is a current difference $\Delta I_{drain}$ between $I_A$ and $I_B$. Since the OLED display is driven by current, when there is the current difference, the display brightness of the pixel $P_b$ driven by $I_A$ is different from the display brightness of the pixel $P_w$ driven by $I_B$, then the residual image appears.

Figure 3:
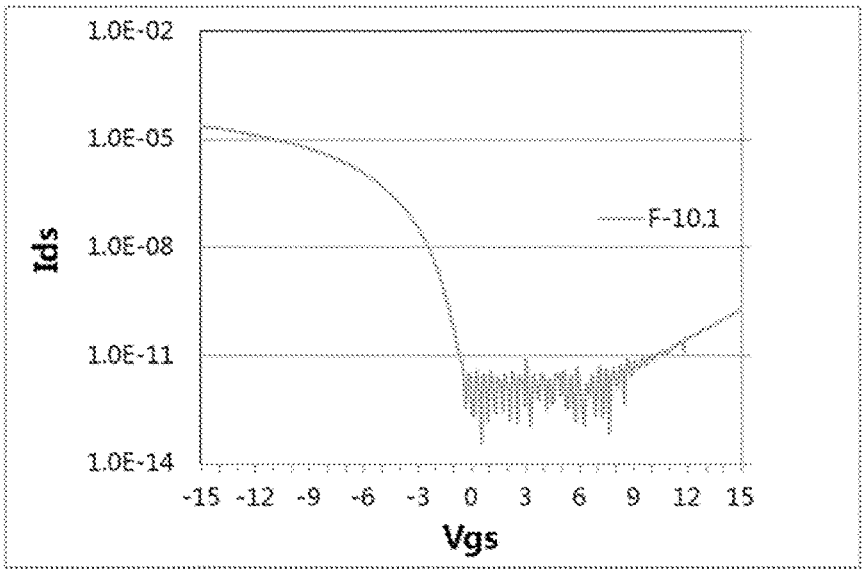
FIG. 3 is a schematic view of an ideal current-voltage curve of an OLED in some embodiments of the present disclosure.

For example, in the AMOLED display, different gray-levels (i.e., different brightness) of the pixel correspond to different driving voltages of the pixel. The driving voltage of the pixel corresponding to the 255 gray-level is $V_{255}$, the driving voltage of the pixel corresponding to the 155 gray-level is $V_{125}$, and the driving voltage of the pixel corresponding to the 0 gray-level is $V_0$. When the display device is working, the driving voltage of the pixel is switched between $V_0$ and $V_{255}$ to display the image with different brightness. When the driving voltage of the pixel is switched between $V_0$ and $V_{255}$, the gate voltage of the DTFT driving the pixel is switched between $V_{255}$ and $V_0$. For an ideal TFT device, the current-voltage curve of the TFT in case of the driving voltage decreasing from V255 to V0 gradually (i.e., a forward scan) should be coincide with the current-voltage curve of the TFT in case of the driving voltage increasing from V0 to V255 gradually (i.e., a reverse scan), that is, as shown in FIG. 3, the current-voltage curves obtained in the forward scan and the reverse scan are coincide with each other.

However, due to the hysteresis in the actual working process, the current-voltage curves obtained in the forward scan and the reverse scan are not coincide with each other. As shown in FIG. 2, the curve ① is obtained in the forward scan, the curve ② is obtained in the reverse scan, the same driving voltage corresponds to different currents, that is, the same driving voltage corresponds to different brightness. As a result, a short-term residual image appears. As shown in FIG. 2, the voltage value corresponds to the current I in the curve ① is V11, the voltage value corresponds to the current I in the curve ② is V22, and the threshold voltage separation amount=V22−V11.

When the screen displays a black-and-white checkerboard image continuously and the image on the screen is switched to the middle gray-level image (the gray-level of the pixel in the middle gray-level image is a positive integer greater than 0 and smaller than 255), the driving voltages of all the pixels in the middle gray-level image are $V_{gs}$1'. There will be a current difference $\Delta I_{drain}$ between the driving current of switching the pixel M1 in the black checkerboard to the middle gray-level image and the driving current of switching the pixel M2 in the white checkerboard to the middle gray-level image, then the display brightness of the pixel M1 and the pixel M2 may be different as a result, which seems like that the residual image of the checkerboard still remains on the display.

To avoid or reduce the residual image, the driving current of switching the pixel in the high gray-level image to the middle gray-level image and the driving current of switching the pixel in the low gray-level image to the middle gray-level image may be the same or close to each other.

In some embodiments of the present disclosure, the driving current of switching the pixel in the high gray-level image to the middle gray-level image and the driving current of switching the pixel in the low gray-level image to the middle gray-level image are set to the same value, which includes: the driving voltage V1 of the pixel P1 in the high gray-level image is switched to $V_{gs}2$, and the driving voltage of the pixel P2 in the low gray-level image is switched to $V_{gs}1$, where $V1>V_{gs}2>V_{gs}1$, thereby ensuring that the driving current of the pixel P1 in the high gray-level image is identical to the driving current of the pixel P2 in the low gray-level image. Then, the driving voltage of the pixel P1 is switched from $V_{gs}2$ to $V_{gs}1$, thereby alleviating the residual image caused by the hysteresis.

In some embodiments of the present disclosure, for the dynamic display image, when the high gray-level image is switched to the transition image (i.e., the driving voltage V1 of the pixel P1 in the high gray-level image is switched to $V_{gs}2$), after the transition image has been displayed continuously for 16.67 ms (i.e., the driving voltage of the pixel P1 has been kept at the transition voltage for 16.67 ms), the driving voltage of the pixel P1 is switched to $V_{gs}1$.

In some embodiments of the present disclosure, for the static display image, a plurality of frames of inbetween images are inserted between the high gray-level image and the middle gray-level image. After displaying the plurality of frames of inbetween images, the image is switched to the middle gray-level image (the driving voltage of the pixel in the middle gray-level image is $V_{gs}1$), and the voltage switching between two adjacent frames of images is $(1/N)\times(V_{gs}1-V_{gs}2)$, where $V_{gs}2$ is a transition voltage, N represents a total number of frames of the plurality of frames of inbetween images.

Figure 5:
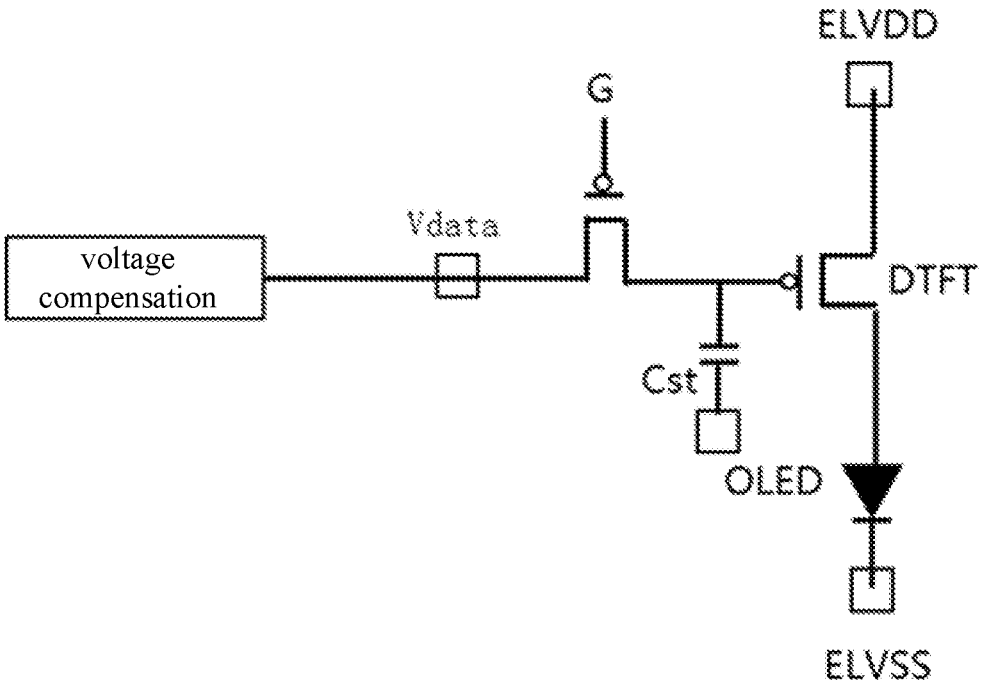
FIG. 5 is a schematic view of a circuit in some embodiments of the present disclosure; FIG.

As shown in FIG. 5, the working current of driving the DTFT of the OLED in the AMOLED (the on-state current of the DTFT) is related to ELVDD, the driving voltage Vdata of the pixel and the threshold voltage of the DTFT. That is, $I=\frac{1}{2}*\mu*Cox*W/L\ (V_{gs}-V_{th})^2$, where I is an on-state current of the DTFT, W is a channel width of the channel of the DTFT, L is a channel length of the channel of the DTFT, μ is the field effect mobility, and Cox is the gate insulating layer capacitance per unit area, which is inversely proportional to the thickness of the gate insulating layer, Vth is the threshold voltage of the DTFT, and $V_{gs}$ is the voltage between the gate electrode and the source electrode of the DTFT, where $V_{gs}$=Vdata−ELVDD and Vdata is a voltage written by the chip.

Therefore, after the voltage compensation value $\Delta V_{gs}$ is obtained by testing, the Vdata written by the chip (the driving voltage of the pixel) is compensated by the $\Delta V_{gs}$, the $\Delta V_{gs}$ may be controlled by the Vdata, thereby further controlling the current of the DTFT (i.e., the brightness of the image).

Figure 4:
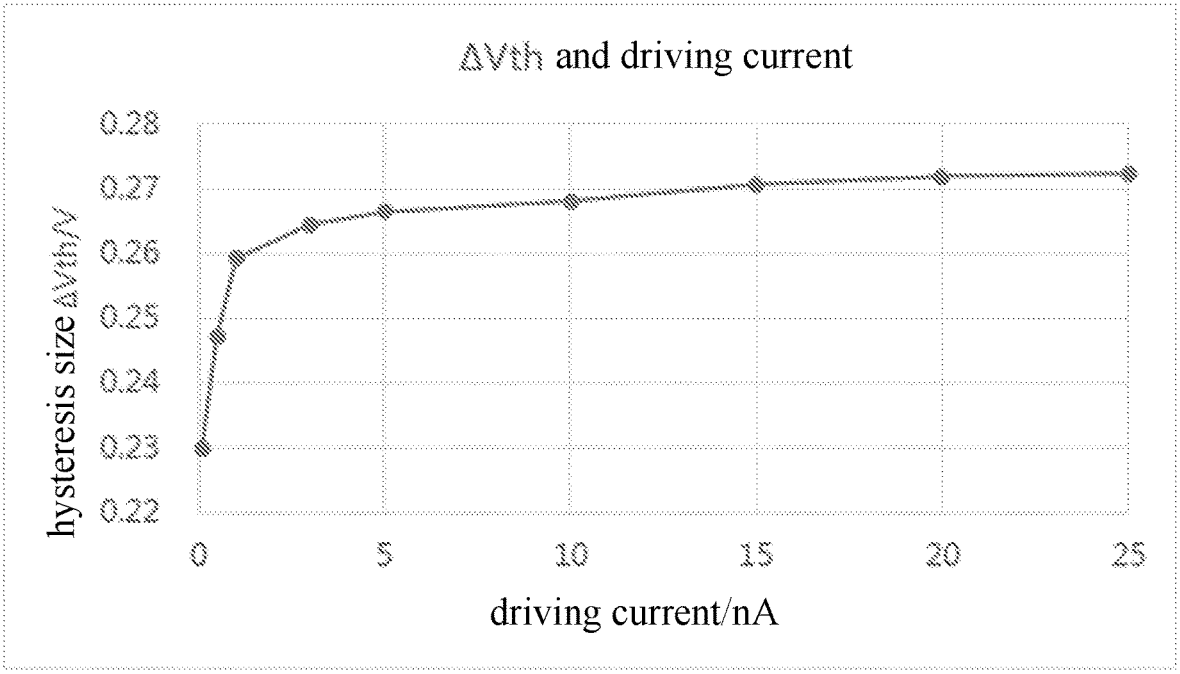
FIG. 4 is a schematic view of a relationship between different working currents and hysteresis.

FIG. 4 shows a relationship between different working currents (on-state current) and hysteresis. In the working current range of the OLED device (0 nA~25 nA), the hysteresis changes a little (e.g., as shown in FIG. 4, the ΔVth is smaller than 0.045V). Therefore, in some embodiments of the present disclosure, the same $\Delta V_{gs}$ ($V_{gs}1-V_{gs}2$) are used to perform a voltage compensation to the DTFT driving the pixel.

For example, the voltage compensation value $\Delta V_{gs}$ is a threshold voltage separation amount of a constant value.

In some embodiments of the present disclosure, through the circuit shown in FIG. 5, a voltage compensation may be performed onto the data signal (i.e., Vdata) of the pixel circuit in case of switching the high gray-level image to the low gray-level image, by the signal form an external chip and based on the degree of the hysteresis of the TFT.

According to the above embodiments of the present disclosure, taking advantage of the stable TFT hysteresis characteristic, a voltage compensation may be performed onto the data signal of the pixel circuit, thereby alleviating the short-term residual image and improving the image display effect.

Figure 6:
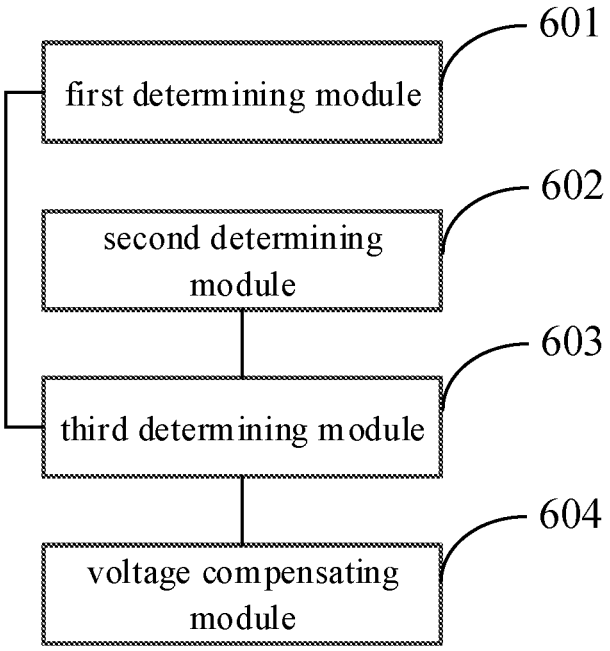
FIG. 6 is a schematic view of a voltage compensation device in some embodiments of the present disclosure.

As shown in FIG. 6, a voltage compensation device provided in some embodiments of the present disclosure includes a first determining module 601, a second determining module 602, a third determining module 603 and a voltage compensating module 604.

The first determining module 601 is configured to determine a first voltage of a target pixel in a first image. The second determining module 602 is configured to determine a second voltage of the target pixel in a second image, where the second image is switched from the first image. The third determining module 603 is configured to determine a voltage compensation value based on the first voltage and the second voltage. The voltage compensating module 604 is configured to determine a transition voltage based on the voltage compensation value and the second voltage, and compensate the second voltage by the transition voltage.

A gray-level of the target pixel in the first image is greater than a gray-level of the target pixel in the second image, the transition voltage is a driving voltage of the target pixel between the first voltage and the second voltage.

Figure 7:
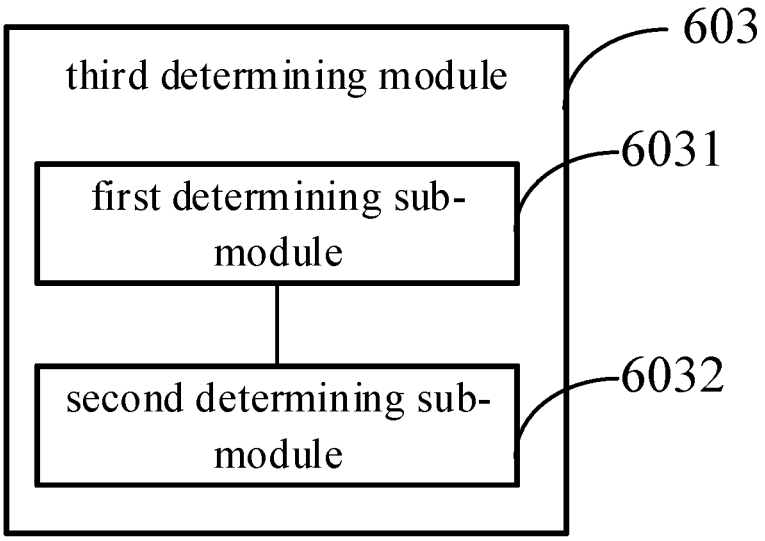
FIG. 7 is a schematic view of a third determining module in some embodiments of the present disclosure.

In some embodiments of the present disclosure, as shown in FIG. 7, the third determining module 603 includes a first determining sub-module 6031 and a second determining sub-module 6032.

The first determining sub-module 6031 is configured to perform a forward scan and a reverse scan respectively to a current-voltage curve for driving a thin film transistor TFT of the target pixel, based on the first voltage and the second voltage, and calculate a threshold voltage separation amount of the TFT based on a scan result.

The second determining sub-module 6032 is configured to determine the threshold voltage separation amount as the voltage compensation value.

Figure 8:
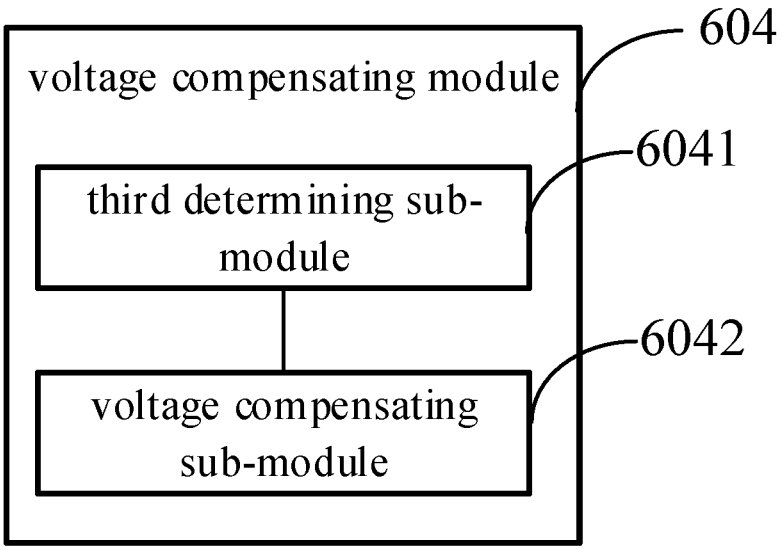
FIG. 8 is a schematic view of a voltage compensation module in some embodiments of the present disclosure.

In some embodiments of the present disclosure, as shown in FIG. 8, the voltage compensating module 604 includes a third determining sub-module 6041 and a voltage compensating sub-module 6042.

The third determining sub-module 6041 is configured to determine a sum of the voltage compensation value and the second voltage as the transition voltage. The voltage compensating sub-module 6042 is configured to compensate the second voltage by the transition voltage.

In some embodiments of the present disclosure, the voltage compensating sub-module 6042 is configured to insert an inbetween image between the first image and the second image, where a voltage adjustment value of the driving voltage of the target pixel between every two adjacent frames is: $1/N\times\Delta V_{gs}$, where N is a positive integer and represents a total number of frames of the inbetween image, and $\Delta V_{gs}$ represents a difference between the second voltage and the transition voltage.

In some embodiments of the present disclosure, the total number of frames of the inbetween image is greater than 1.

In some embodiments of the present disclosure, the voltage compensating sub-module 6042 is configured to switch the driving voltage of the target pixel to the transition voltage, to compensate the second voltage.

In some embodiments of the present disclosure, where the voltage compensating sub-module 6042 is further configured to switch the driving voltage of the target pixel to the second voltage after the driving voltage of the target pixel is kept at the transition voltage continuously for a preset duration.

For example, the preset duration is 16.67 ms.

The working principle of the above device may refer to the above description of the embodiments of the method.

In the embodiment of the present disclosure, when performing screen switching, a voltage compensation value is determined based on the first voltage and the second voltage of the target pixel, and a transition voltage is determined based on the voltage compensation value and the second voltage, and then the second voltage is compensated by the transition voltage. Since the gray-level of the target pixel in the first image is greater than the gray-level of the target pixel in the second image, that is, when a high gray-level image is switched to a low gray-level image, the second voltage is compensated, thereby reducing or avoiding the short-term residual image of the OLED due to the hysteresis.

A display device is provided in some embodiments of the present disclosure, including the voltage compensation device shown in any one of FIG. 6 to FIG. 8.

Figure 9:
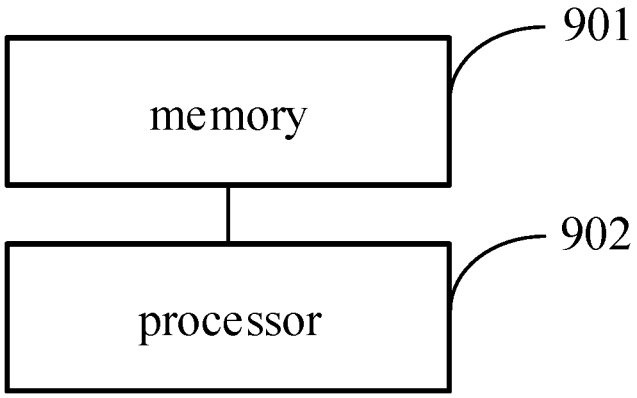
FIG. 9 is a schematic view of a display device in some embodiments of the present disclosure.

As shown in FIG. 9, a display device in some embodiments of the present disclosure includes: a memory 901, a processor 902 and a computer program stored in the memory 901 and executable on the processor, where the computer program is executed by the processor 902 to:

determine a first voltage of a target pixel in a first image;

determine a second voltage of the target pixel in a second image, where the second image is switched from the first image;

determine a voltage compensation value based on the first voltage and the second voltage; and determine a transition voltage based on the voltage compensation value and the second voltage, and compensate the second voltage by the transition voltage;

a gray-level of the target pixel in the first image is greater than a gray-level of the target pixel in the second image, the transition voltage is a driving voltage of the target pixel between the first voltage and the second voltage.

In some embodiments of the present disclosure, the computer program is executed by the processor 902 to:

perform a forward scan and a reverse scan respectively to a current-voltage curve for driving a thin film transistor TFT of the target pixel, based on the first voltage and the second voltage, and calculate a threshold voltage separation amount of the TFT based on a scan result; and determine the threshold voltage separation amount as the voltage compensation value.

In some embodiments of the present disclosure, the computer program is executed by the processor 902 to:

determine a sum of the voltage compensation value and the second voltage as the transition voltage; and compensate the second voltage by the transition voltage.

In some embodiments of the present disclosure, the computer program is executed by the processor 901 to:

insert an inbetween image between the first image and the second image, where a voltage adjustment value of the driving voltage of the target pixel between every two adjacent frames is: $1/N \times \Delta Vgs$, where N is a positive integer and represents a total number of frames of the inbetween image, and $\Delta Vgs$ represents a difference between the second voltage and the transition voltage.

In some embodiments of the present disclosure, the computer program is executed by the processor 902 to:

switch the driving voltage of the target pixel to the transition voltage, to compensate the second voltage.

In some embodiments of the present disclosure, the computer program is executed by the processor 902 to:

switch the driving voltage of the target pixel to the second voltage, after the driving voltage of the target pixel is kept at the transition voltage continuously for a preset duration.

In addition, a computer-readable storage medium configured to store a computer program is provided in some embodiments of the present disclosure, the computer program is executed by a processor to:

determine a first voltage of a target pixel in a first image;

determine a second voltage of the target pixel in a second image, where the second image is switched from the first image;

determine a voltage compensation value based on the first voltage and the second voltage; and determine a transition voltage based on the voltage compensation value and the second voltage, and compensate the second voltage by the transition voltage;

a gray-level of the target pixel in the first image is greater than a gray-level of the target pixel in the second image, the transition voltage is a driving voltage of the target pixel between the first voltage and the second voltage.

In some embodiments of the present disclosure, the determining the voltage compensation value based on the first voltage and the second voltage includes:

performing a forward scan and a reverse scan respectively to a current-voltage curve for driving a thin film transistor TFT of the target pixel, based on the first voltage and the second voltage, and calculating a threshold voltage separation amount of the TFT based on a scan result;

determining the threshold voltage separation amount as the voltage compensation value.

In some embodiments of the present disclosure, the determining the transition voltage based on the voltage compensation value and the second voltage and compensating the second voltage by the transition voltage includes:

determining a sum of the voltage compensation value and the second voltage as the transition voltage; and compensating the second voltage by the transition voltage.

In some embodiments of the present disclosure, the compensating the second voltage by the transition voltage includes:

inserting an inbetween image between the first image and the second image, where a voltage adjustment value of the driving voltage of the target pixel between every two adjacent frames is: $1/N \times \Delta Vgs$, where N is a positive integer and represents a total number of frames of the inbetween image, and $\Delta Vgs$ represents a difference between the second voltage and the transition voltage.

In some embodiments of the present disclosure, the compensating the second voltage by the transition voltage includes:

switching the driving voltage of the target pixel to the transition voltage, to compensate the second voltage.

In some embodiments of the present disclosure, the compensating the second voltage by the transition voltage includes: switching the driving voltage of the target pixel to the second voltage, after the driving voltage of the target pixel is kept at the transition voltage continuously for a preset duration.

In the embodiments in the present application, it should be understood that the disclosed method and apparatus may be implemented in other manners. For example, the device embodiments described above are merely illustrative. For example, the division of the unit is only a logical function division. In actual implementation, there may be another division manner, for example, multiple units or components may be combined or may be integrated into another system, or some features may be ignored or not executed.

In addition, the mutual coupling or direct coupling or communication connection shown or discussed may be an indirect coupling or communication connection through some interface, device or unit, and may be in an electrical, mechanical or other form.

In addition, each functional unit in each embodiment of the present disclosure may be integrated into one processing unit, or each unit may be physically included separately, or two or more units may be integrated into one unit. The above integrated unit may be implemented in the form of hardware or in the form of hardware plus software functional units.

The above-described integrated unit implemented in the form of a software functional unit may be stored in a computer readable storage medium. The above software functional unit is stored in a storage medium and includes a plurality of instructions for causing a computer device (which may be a personal computer, a server, or a network device, etc.) to perform part of the steps of the transceiving method of the various embodiments of the present disclosure. The foregoing storage medium includes: a U disk, a mobile hard disk, a read-only memory (ROM), a random access memory (RAM), a magnetic disk, or an optical disk, and the like, and the program code can be stored. Medium.

The above are merely some embodiments of the present disclosure, and it should be noted that those skilled in the art may also make several improvements and modifications without departing from the principles of the present disclosure, and such improvements and modifications also fall into the scope of the present disclosure.

What is claimed is:

1. A voltage compensation method, comprising:

determining a first voltage of a target pixel in a first image;

determining a second voltage of the target pixel in a second image, wherein the second image is switched from the first image;

determining a voltage compensation value based on the first voltage and the second voltage; and determining a transition voltage based on the voltage compensation value and the second voltage, and compensating the second voltage by the transition voltage;

wherein a gray-level of the target pixel in the first image is greater than a gray-level of the target pixel in the second image, the transition voltage is a driving voltage of the target pixel between the first voltage and the second voltage.

2. The method according to claim 1, wherein the determining the voltage compensation value based on the first voltage and the second voltage comprises:

performing a forward scan and a reverse scan respectively to a current-voltage curve for driving a thin film transistor TFT of the target pixel, based on the first voltage and the second voltage, and calculating a threshold voltage separation amount of the TFT based on a scan result;

determining the threshold voltage separation amount as the voltage compensation value.

3. The method according to claim 2, wherein the determining the transition voltage based on the voltage compensation value and the second voltage and compensating the second voltage by the transition voltage comprises:

determining a sum of the voltage compensation value and the second voltage as the transition voltage; and compensating the second voltage by the transition voltage.

4. The method according to claim 1, wherein the determining the transition voltage based on the voltage compensation value and the second voltage and compensating the second voltage by the transition voltage comprises:

determining a sum of the voltage compensation value and the second voltage as the transition voltage; and compensating the second voltage by the transition voltage.

5. The method according to claim 4, wherein the compensating the second voltage by the transition voltage comprises:

inserting an inbetween image between the first image and the second image, wherein a voltage adjustment value of the driving voltage of the target pixel between every two adjacent frames is: $1/N \times \Delta V_{gs}$, wherein N is a positive integer and represents a total number of frames of the inbetween image, and $\Delta V_{gs}$, represents a difference between the second voltage and the transition voltage.

6. The method according to claim 4, wherein the compensating the second voltage by the transition voltage comprises:

switching the driving voltage of the target pixel to the transition voltage, to compensate the second voltage.

7. The method according to claim 6, wherein the compensating the second voltage by the transition voltage comprises:

switching the driving voltage of the target pixel to the second voltage, after the driving voltage of the target pixel is kept at the transition voltage continuously for a preset duration.

8. A display device, comprising: a memory, a processor and a computer program stored in the memory and executable by the processor, wherein the computer program is executed by the processor to perform the method according to claim 1.

9. A computer-readable storage medium configured to store a computer program, wherein the computer program is executed by a processor to perform the method according to claim 1.

10. A voltage compensation device, comprising:

a first determining module, configured to determine a first voltage of a target pixel in a first image;

a second determining module, configured to determine a second voltage of the target pixel in a second image, wherein the second image is switched from the first image;

a third determining module, configured to determine a voltage compensation value based on the first voltage and the second voltage; and a voltage compensating module, configured to determine a transition voltage based on the voltage compensation value and the second voltage, and compensate the second voltage by the transition voltage;

wherein a gray-level of the target pixel in the first image is greater than a gray-level of the target pixel in the second image, the transition voltage is a driving voltage of the target pixel between the first voltage and the second voltage.

11. The device according to claim 10, wherein the third determining module comprises:

a first determining sub-module, configured to perform a forward scan and a reverse scan respectively to a current-voltage curve for driving a thin film transistor TFT of the target pixel, based on the first voltage and the second voltage, and calculate a threshold voltage separation amount of the TFT based on a scan result;

a second determining sub-module, configured to determine the threshold voltage separation amount as the voltage compensation value.

12. The device according to claim 11, wherein the voltage compensating module comprises:

a determining sub-module, configured to determine a sum of the voltage compensation value and the second voltage as the transition voltage; and a voltage compensating sub-module, configured to compensate the second voltage by the transition voltage.

13. The device according to claim 10, wherein the voltage compensating module comprises:

a determining sub-module, configured to determine a sum of the voltage compensation value and the second voltage as the transition voltage; and a voltage compensating sub-module, configured to compensate the second voltage by the transition voltage.

14. The device according to claim 13, wherein the voltage compensating sub-module is configured to insert an inbetween image between the first image and the second image, wherein a voltage adjustment value of the driving voltage of the target pixel between every two adjacent frames is: $1/N \times \Delta V_{gs}$, wherein N is a positive integer and represents a total number of frames of the inbetween image, and $\Delta V_{gs}$ represents a difference between the second voltage and the transition voltage.

15. The device according to claim 13, wherein the voltage compensating sub-module is configured to switch the driving voltage of the target pixel to the transition voltage, to compensate the second voltage.

16. The device according to claim 15, wherein the voltage compensating sub-module is further configured to switch the driving voltage of the target pixel to the second voltage after the driving voltage of the target pixel is kept at the transition voltage continuously for a preset duration.

17. A display device, comprising the voltage compensation device according to claim 10.

* * * * *